US006148537A

United States Patent [19]

Altamore

[11] Patent Number: 6,148,537

[45] Date of Patent: Nov. 21, 2000

[54] HAIR DRYING DEVICE WITH REDUCED SOUND EMISSIONS

[75] Inventor: Nicolo Altamore, Rockford, Ill.

[73] Assignee: Wahl Clipper Corporation, Sterling, Ill.

[21] Appl. No.: 09/173,833

[22] Filed: Oct. 16, 1998

[51] Int. Cl.[7] ..... F26B 25/00; A45D 00/00

[52] U.S. Cl. ..... 34/97

[58] Field of Search ..... 34/96, 97, 98, 34/99, 100; 392/374, 380, 385; D28/13, 32; 181/211, 68.1, 262, 283; 165/154, 76

[56] References Cited

U.S. PATENT DOCUMENTS 4,265,332 5/1981 Presnall et al. ..... 181/211
4,858,722 8/1989 Abbe et al. ..... 181/243
5,555,637 9/1996 Montagnino ..... 34/97
5,875,562 3/1999 Fogarty ..... 34/97

*Primary Examiner*—Stephen Gravini
*Attorney, Agent, or Firm*—Greer, Burns & Crain, Ltd.

[57] ABSTRACT

A hot air blower such as a hair dryer utilizes an inner body with an inlet, sides and a front outlet end. The inner body houses a heater, a motor and a fan. The motor rotates the fan so that air is drawn in the back inlet end, heated and forced out through the front outlet end.

A muffler surrounds the inlet and sides of the inner body, but does not cover the opening in the outlet. At least one, and preferably two, inlets are disposed on the muffler and are preferably positioned a predetermined distance from the front end, facing the front end.

7 Claims, 1 Drawing Sheet

HAIR DRYING DEVICE WITH REDUCED SOUND EMISSIONS

FIELD OF THE INVENTION

The present invention relates generally to hand-held hot air blowing devices, such as blow dryers or hair dryers. More specifically, it concerns a hair dryer for drying hair which is less noisy than conventional devices.

BACKGROUND OF THE INVENTION

Hair dryers and blow dryers are well known in the prior art. Conventional blow dryers utilize a tubular body secured to a handle. The body holds a heating element and a motor that rotates a fan. In operation, the rotation of the fan draws air into the body through an inlet located at the back end or sides of the body. The fan then blows the air past the heating element to warm the air. Finally, the heated air is blown out of the dryer through an outlet at the front end of the body. However, the motor and the high speed rotation of the fan typically generate noise that escapes the dryer body through the outlet, inlets, vents or other openings in the body, as well as the wall of the body itself.

Whether at home or in a professional setting, such as a hair salon, hair dryers are used to blow dry hair after cleaning and/or wetting the hair. The device is used near the person's ears, so the noise is at least a nuisance. Moreover, at home this is often accomplished early in the morning or late in the evening, when it would be helpful to have a quiet hair dryer so as not to disturb other people in the house, such as a sleeping spouse or child. In professional settings, a large number of hair dryers may be operating at once, creating noise levels that may be so loud that it is difficult for the hair stylists and customers to hear each other talk. Thus, there is a need for dryers which are less noisy than typical dryers.

This noise can also be a problem with other hot air gun applications. For example, paint guns that blow air may be too loud to use during certain times in residential neighborhoods. The inventor contemplates that any air blowing device may need quieter operation in certain situations.

Accordingly, one object of the present invention to provide a new and improved blow dryer.

Another object is to provide a new and improved blow dryer that creates a relatively low level of sound emissions.

Still another object is to provide a new and improved hair dryer which is relatively quiet.

SUMMARY OF THE INVENTION

These and other objects are met or exceeded by the present blow dryer. The invention utilizes an inner body with an air inlet usually in a back end of the body, sides and a front outlet end. The inner body houses a heater, a motor and a fan. The motor rotates the fan so that air is drawn in the inlet, heated and forced out through the outlet.

A muffler surrounds the back end and sides of the inner body, including the air inlet, but does not cover the opening in the outlet. At least one, and preferably two, air openings are disposed on the muffler and are preferably positioned a predetermined distance from the front end, facing the front end.

BRIEF DESCRIPTION OF THE DRAWINGS

The above mentioned and other features of this invention and the manner of obtaining them will become more apparent and the invention itself will be best understood by reference to the following description taken in conjunction with the drawings, in which.

DETAILED DESCRIPTION OF THE INVENTION

Figure 2:
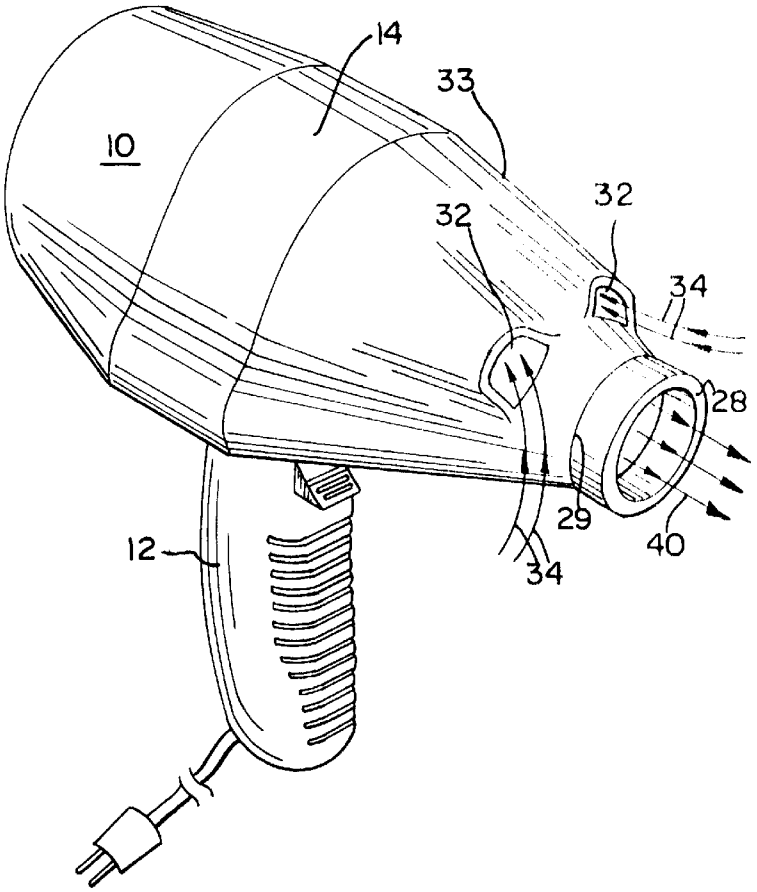
FIG. 2 is a top and side isometric view of the blow dryer of FIG. 1, also showing the direction of airflow.
Figure 1:
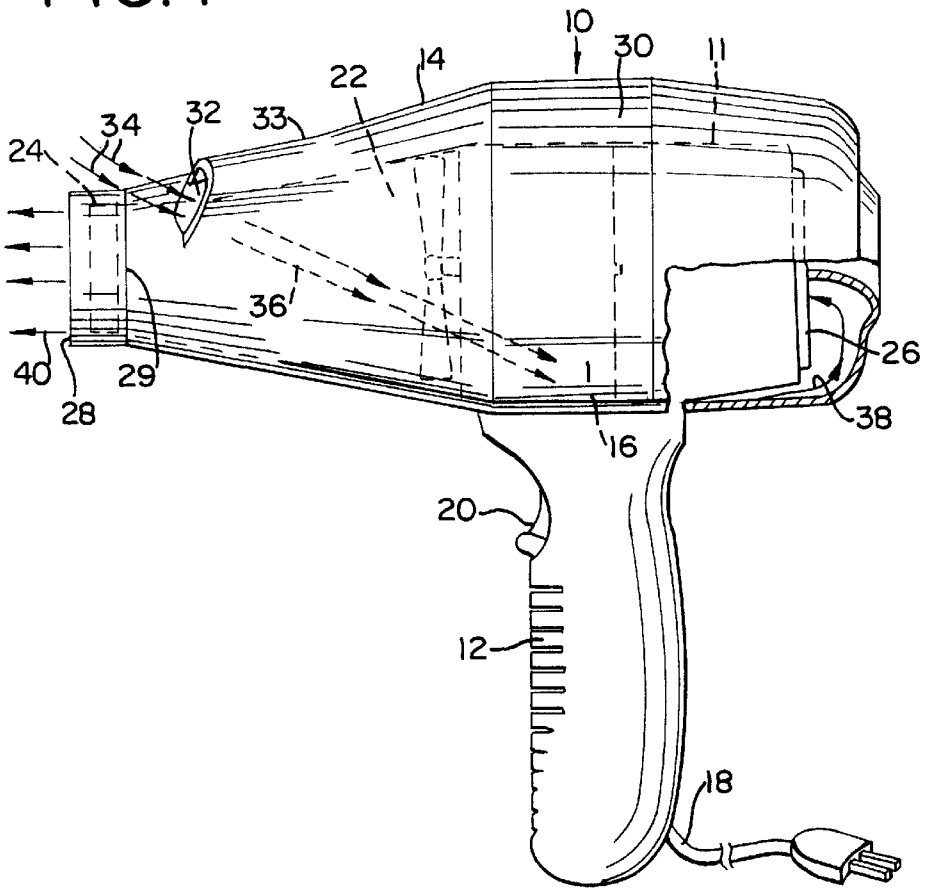
FIG. 1 is a side view and partial section view of a blow dryer, made in accordance with the principles of this invention, showing the direction of airflow in the dryer.

Referring now to FIGS. 1 and 2, a blow dryer 10 has an inner body 11, a handle 12 and a muffler 14. The inner body 11 houses a motor 16 powered by a source 18 through a switch 20, a fan 22 which is turned by the motor 16, and a heater 24 which is also powered by the source 18. The body 11 has an air inlet 26 at a back end of the body, and an air outlet 28 at the front end.

The muffler 14 surrounds and encloses the inner body 11, while maintaining an air space 30 between the inner body 11 and the muffler 14. The muffler 14 can extend to the outlet 28, or behind the outlet 28 at a line 29, as in the drawings. For an inner body about 8–10 inches long, the line 29 can be about ¼ to 2 inches behind the outlet 28. The air space 30 can be about ⅜–1 inch wide between the inner body 1 and the muffler 14. In either case, for the most part, only the air outlet 28 is exposed by the muffler 14.

Air enters the air space 30 through air openings 32 in the muffler 14, which are preferably located near, yet are removed from the air outlet 28. A sloped surface 33 can be provided in the muffler 14 to allow the openings 32 to face the air outlet 28, if desired. The openings can also simply be raised to face the outlet, as shown. The openings 32 can be about 1.5 to 3 inches from the outlet 28, or any other suitable distance. It is not expected that much pre-heated air will be drawn in the air openings 32, although that is possible.

The handle 12 may be any suitable shape, and houses the switch 20. Preferably, the handle 12 can easily be used in both the left and the right hands.

In operation, air drawn into the inlets 32 (depicted by arrows 34 in FIG. 1) is drawn toward the back end 26 by the fan (as depicted by arrows 36 in FIG. 1). The suction of the fan then reverses the direction of the drawn air (as depicted by arrows 38 in FIG. 1), and propels the air toward the air inlet 26, past the motor 16 and heating element 24 and out through the outlet 28 (as depicted by arrows 40). Noise is absorbed and dissipated by the muffler 14 and the air space 30, which significantly reduces the noise generated by the device.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

What is claimed is:

1. A hair drying device, comprising:

an inner body having an air inlet, an air outlet, a heater and means for drawing air through said inner body in a first direction to be heated by said heater and emitted by said means for drawing air in said first direction; and a muffler which surrounds said inner body, including said air inlet, but not said air outlet, said muffler being separated from said inner body by an airspace, said muffler having at least one air opening positioned on said muffler at a distance from said air outlet such that internal noise is absorbed by said muffler, without excessive recirculation of heated air.

2. The hair drying device defined in claim 1, wherein said inner body has a front end in which said air outlet is disposed, said air opening faces said front end.

3. The hair drying device defined in claim 1 wherein said at least one air opening is disposed on said muffler so that incoming air is provided to said air inlet in a second direction which is distinct from said first direction.

4. The hair drying device defined in claim 3 wherein said at least one air opening is disposed on said muffler so that said first direction is generally reverse to said second direction.

5. A hair drying device, comprising:

an inner body having an air inlet, an air outlet, a heater and means for drawing air through said inner body in a first direction to be heated by said heater and emitted by said means for drawing air in said first direction; and a muffler which surrounds said inner body, including said air inlet, but not said air outlet, said muffler being separated from said inner body by an airspace, said muffler having at least one air opening positioned on said muffler at a distance from said air outlet such that internal noise is absorbed by said muffler, without excessive recirculation of heated air;

said at least one air opening is disposed on said muffler so that incoming air is provided to said air inlet in a second direction which is generally reverse to said first direction.

6. The hair drying device defined in claim 5, wherein said inner body has a front end in which said air outlet is disposed, said air opening faces said front end.

7. A hair drying device, comprising:

an inner body having an air inlet, an air outlet, a heater and means for drawing air through said inner body in a first direction to be heated by said heater and emitted by said means for drawing air; and a muffler which substantially surrounds said inner body, including said air inlet, so that only said air outlet is exposed, said muffler having a front end and being separated from said inner body by an airspace, said muffler having at least one air opening positioned on said muffler at a distance from said air outlet such that internal noise is absorbed by said muffler, without excessive recirculation of heated air;

said at least one air opening is disposed on said front end of said muffler so that incoming air is provided to said air inlet in a second direction which is generally reverse to said first direction.

* * * * *